United States Patent [19]

Pedrow

[11] Patent Number: 4,756,090

[45] Date of Patent: Jul. 12, 1988

[54] ORTHOPEDIC PILLOW AND SIZING KIT THEREFOR

[76] Inventor: John Pedrow, 14429 Rte. 30, North Huntingdon, Pa. 15642

[21] Appl. No.: 84,674

[22] Filed: Aug. 12, 1987

[51] Int. Cl.[4] ..... A47G 9/00

[52] U.S. Cl. ..... 33/512; 5/436; 128/78

[58] Field of Search ..... 5/434, 436, 431; 128/69, 78; 33/512, 511

[56] References Cited

U.S. PATENT DOCUMENTS

| | | | |
|---|---|---|---|
| 2,111,648 | 3/1938 | Stone | 33/512 |
| 2,880,428 | 2/1957 | Forsland | 5/337 |
| 4,218,792 | 8/1980 | Kogan | 5/436 |
| 4,320,543 | 3/1982 | Dixon | 5/434 |
| 4,424,599 | 1/1984 | Hannouche | 5/436 |
| 4,432,107 | 2/1984 | Clark et al. | 5/436 |
| 4,494,261 | 1/1985 | Morrow | 5/436 |
| 4,501,034 | 2/1985 | Greenawalt | 5/441 |
| 4,528,705 | 7/1985 | Greenawalt | 5/441 |
| 4,550,458 | 11/1985 | Fiore | 5/434 |
| 4,550,459 | 11/1985 | Endel et al. | 5/437 |

*Primary Examiner*—Alexander Grosz
*Attorney, Agent, or Firm*—Nils H. Ljungman

[57] ABSTRACT

An orthopedic pillow having a block made of deformable material, the block having a substantially quadrilateral perimeter, an upper surface of the block having a substantially airfoil-shaped reverse curved surface, and a groove being provided in the upper surface, the groove being sized and adapted to accommodate the cervical vertebrae of a user of the orthopedic pillow. A sizing kit for determining an appropriate size of orthopedic pillow for use by a patient is also described.

17 Claims, 3 Drawing Sheets

ORTHOPEDIC PILLOW AND SIZING KIT THEREFOR

BACKGROUND OF THE INVENTION

1. Field of the Invention

The present invention relates to an orthopedic pillow for correctly maintaining the physiologic curvature of the cervical vertebrae of a user in a supine position, and to a nestable and, therefore, easily storable sizing kit for determining the proper size of such an orthopedic pillow for use by a particular patient.

2. Description of the Prior Art

Cervical pillows of various configurations designed with the purpose of supporting the cervical vertebrae of a user in a naturally curved and, therefore, unstressed position are known in the prior art.

U.S. Pat. No. 2,880,428 to Forsland relates to a posture pillow having an upper surface in the form of a flattened S-curve, an elevated portion of which is located beneath the user's neck, while the user's head rests on a lower portion of the pillow.

U.S. Pat. No. 4,494,261 to Morrow concerns a composite head and neck cushion for use by a person in a supine position, the cushion including a first, resilient member having an upper surface which conforms to and supports the physiologic curvature of the cervical vertebrae and a second member which supports the head in a raised but unflexed position.

U.S. Pat. No. 4,218,792 to Kogan relates to an orthopedic pillow of generally rectangular shape, the base of the rectangle adjacent the user's shoulders being formed with a concave frontal curvature, the rectangular block having a depression formed therein for the user's head and the depression being connected to the base by a recess formed in the concave frontal curvature.

Other examples of orthopedic support devices to be found in the prior art are shown in U.S. Pat. Nos. 4,320,543; 4,424,599; 4,432,107; 4,528,705; 4,550,458; 4,501,034 and 4,550,459.

All of the above-mentioned patents are hereby expressly incorporated by reference as if set forth in their entirety within the present specification.

OBJECTS OF THE INVENTION

One object of the present invention is the provision of an improved orthopedic pillow which supports the cervical vertebrae of a user in a naturally curved and, therefore, unstressed state.

Another object of the invention is the provision of such an orthopedic pillow in an efficient and simplified design which is, therefore, readily and inexpensively manufactured.

A yet further object of the present invention is the provision of a sizing kit for determining what size of such an orthopedic pillow is appropriate for use by a particular patient.

An even further object of the present invention is the provision of such a sizing kit which includes a multiplicity of individually sized members, the members being so configured as to be readily and easily stacked into a compact and conveniently storable package.

SUMMARY OF THE INVENTION

In one aspect, the invention features an orthopedic pillow which includes a block made of a deformable material, the block having a substantially quadrilateral perimeter when viewed in plan, an upper surface of the block having a substantially airfoil-shaped reverse curved surface when the block is viewed in elevation, and a groove provided in the upper surface of the block, the groove being sized and adapted to accommodate the cervical vertebrae of a user of the orthopedic pillow.

In preferred embodiments, the groove runs from one end of the pillow to the opposite end of the pillow and the groove runs up over the substantially airfoil-shaped reverse curved surface from one end to the other opposite end of the pillow.

In another aspect, the invention features a sizing kit for determining an appropriate size of orthopedic pillow for use by a patient, the sizing kit including an ordered multiplicity of members, each of the members having a substantially quadrilateral perimeter when viewed in plan, each of the substantially quadrilateral perimeters of the multiplicity of members having a substantially common first characterizing dimension and a second characterizing dimension, the second characterizing dimensions increasing from ordered member to ordered member such that the number of distinct second characterizing dimensions corresponds to the number of the multiplicity of members, each of the members having an upper surface which is substantially airfoil-shaped and reverse curved, and each of the ordered multiplicity of members, other than a first member of the ordered multiplicity, having a lower surface which substantially corresponds to the substantially airfoil-shaped reverse curved upper surface of the preceding member in the ordered multiplicity, such that the ordered multiplicity of members are stackable one upon the other according to order to produce a compact and therefore readily storable package.

In preferred embodiments, each of the ordered multiplicity of members is formed of plastic and is hollow, there are provided interconnecting means for interconnecting the ordered multiplicity of members when the members are stackable one upon the other to form the readily storable package and provision is made for hanging the readily storable package.

These and other features of the present invention will now be described by way of a preferred embodiment, after first briefly describing the accompanying drawings, wherein:

DESCRIPTION OF THE PREFERRED EMBODIMENT

Figure 1:
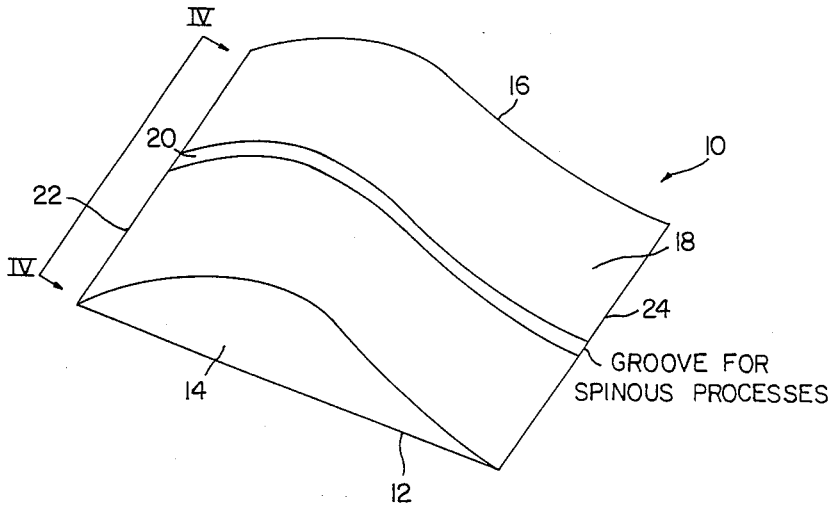
FIG. 1 is an isometric view of an orthopedic pillow constructed according to the present invention.

Referring first to FIGS. 1–4, an orthopedic pillow 10 is formed from a block of a deformable material which has a generally quadrilateral perimeter when viewed in plan. The block of deformable material is bounded by a lower surface 12, an upper surface 18 and side walls 14 and 16. For ease of construction, lower surface 12 and side walls 14 and 16 are generally substantially planar surfaces. However, the particular configuration of these surfaces is not an essential aspect of the invention, and the present invention is contemplated as encompassing orthopedic pillows having non-planar lower and side surfaces. Aspects of the pillows in the patents incorporated herein by reference may be used instead of the ones shown in the figures described above.

The upper surface 18 of the block of deformable material which makes up orthopedic pillow 10 is formed so as to have a substantially airfoil-shaped and reverse curved configuration and includes a recessed groove 20 located approximately medially between side walls 14 and 16 and extending from an upper edge 22 to a lower edge 24 of orthopedic pillow 10.

Figure 2:
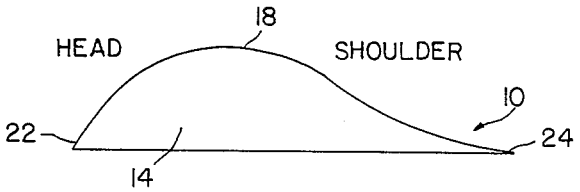
FIG. 2 is an elevational side view of the orthopedic pillow of FIG. 1.
Figure 3:
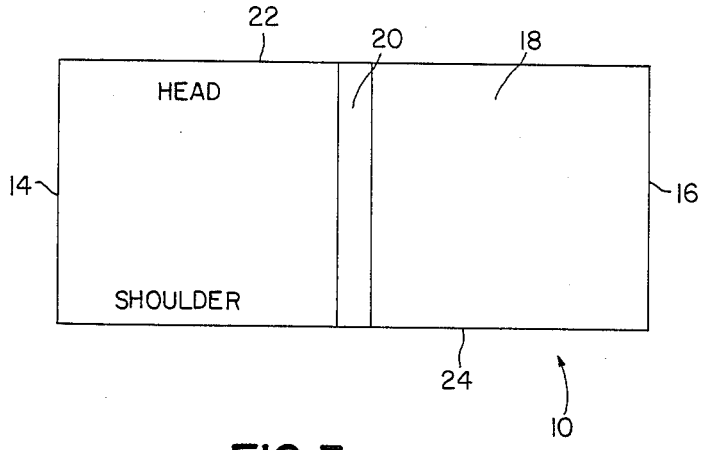
FIG. 3 is a top plan view of the orthopedic pillow of FIG. 1.
Figure 4:
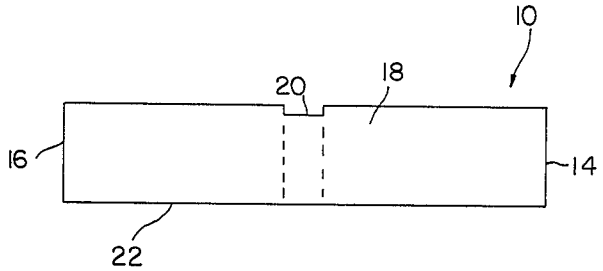
FIG. 4 is an elevational edge view taken along the lines IV—IV of the orthopedic pillow shown in FIG. 1.

The orthopedic pillow which is the subject of the present invention is so configured that, referring most particularly now to FIG. 2, when the user is in a supine position with his head proximate the upper edge 22 and with his shoulders located overlying or slightly above lower edge 24, the user's cervical vertebrae will be maintained in a posterior facing arch, which is the natural or unflexed state of the cervial vertebrae. Additionally, recessed groove 20 is dimensioned and adapted to accommodate the cervical vertebrae of the user and thus prevent or reduce any undue pressure which might be otherwise exerted.

Figure 5:
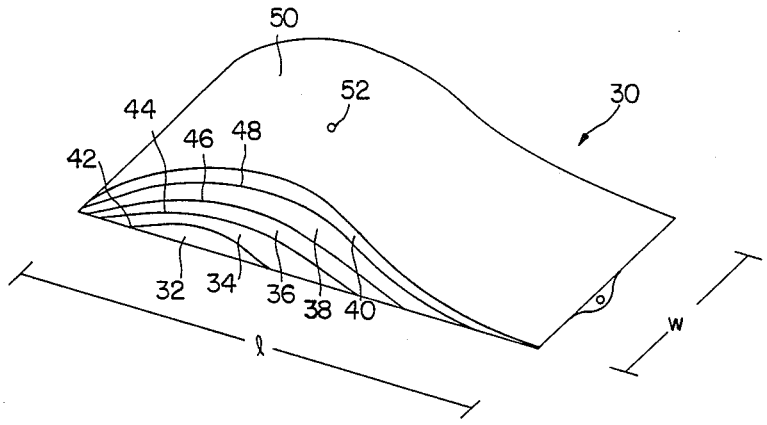
FIG. 5 is an isometric view of an orthopedic pillow sizing kit constructed according to the present invention.
Figure 6:
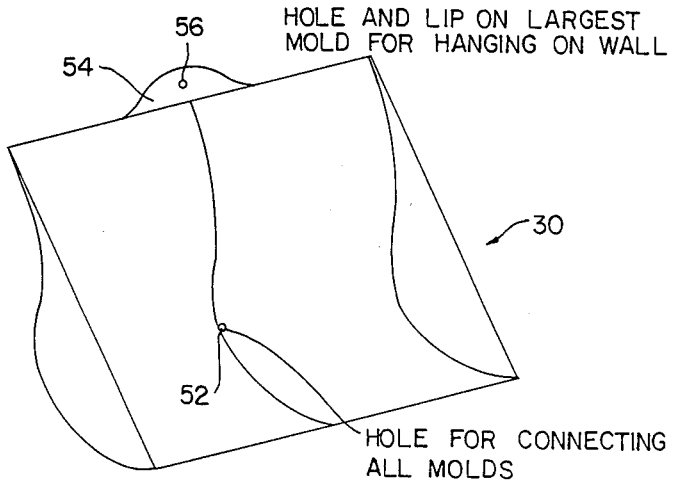
FIG. 6 is yet another isometric view of the orthopedic pillow sizing kit shown in FIG. 5.

Referring now to FIGS. 5 and 6, a sizing kit 30 for determining the appropriate size of orthopedic pillow 10 for use by a patient generally includes an ordered multiplicity of individual members 32–40, each of said individual members 32–40 having a common width w. The lengths 1 of said members 32–40 increases with respect to their order within the set of members, with the length 1 of member 32 being the least and the length 1 of member 40 being the greatest.

Additionally, each of the upper surfaces 42–50 of each of members 32–40, respectively, is generally configured as an airfoil-shaped and reverse curved surface. Moreover, the lower surfaces of each of members 34–40 is also a generally airfoil-shaped reverse curved surface which substantially corresponds to the airfoil-shaped reverse curved surface of the preceding member in the ordered multiplicity of members 32–40. For ease of fabrication, the lower surface of the first member 32 is generally planar. However, sizing kits having a first member with a nonplanar lower surface are contemplated as being within the scope of the present invention.

As a result of the above detailed construction of sizing kit 30, individual ordered members 32–40 may be stacked one upon the other, as shown in FIG. 5, so as to produce a compact and, therefore, readily storable package.

Each of said individual members 32–40 is preferably provided with a throughgoing hole 52, by means of which all of the individual members 32–40 may be interconnected, by means well known in the art, so as to retain the members 32–40 in a stacked, compact and, therefore, readily storable package.

Finally, at least the largest member 40 is provided with a projecting tab portion 54 having a throughgoing hole 56 to enable the assembled sizing kit 30 to be hung on a wall or the like.

The sizing kit 30 of the present invention provides a convenient and compact means for determining the appropriate size of an orthopedic pillow 10 which is appropriate for use by a particular patient. The sizing kit 30 may be disassembled into its individual members for comparison with the particular patient's physique and may be thereafter reassembled and conveniently stored. Aspects of the pillows in the patents incorporated herein by reference may be used instead of the ones shown in the figures described above.

While the invention has been described by way of a particular preferred embodiment, it will be understood by those skilled in the art that various substitutions of equivalents can be made without departing from the spirit and scope of the invention as set forth in the following claims:

What is claimed is:

1. A sizing kit for determining an appropriate size of orthopedic pillow for use by a patient, said orthopedic pillow comprising a block comprising a deformable material, said block having a substantially quadrilateral perimeter when viewed in plan; an upper surface of said block having a substantially airfoil-shaped reverse curved surface when said block is viewed in elevation; and a groove provided in said upper surface, said groove being sized and adapted to accommodate the cervical vertebrae of a user of said orthopedic pillow, said sizing kit comprising:

an ordered multiplicity of members, each of said members having a substantially quadrilateral perimeter when viewed in plan, each of said substantially quadrilateral perimeters of said multiplicity of members having a substantially common first characterizing dimension and a second characterizing dimension, said second characterizing dimensions increasing from ordered member to ordered member such that the number of distinct second characterizing dimensions corresponds to the number of said multiplicity of members;

each of said members having an upper surface which comprises a substantially airfoil-shaped reverse curved surface when said members are viewed in elevation; and each of said ordered multiplicity of members, other than a first member of said ordered multiplicity, having a lower surface which substantially corresponds to said substantially airfoilshaped reverse curved upper surface of the preceding member in said ordered multiplicity;

whereby said ordered multiplicity of members may be stacked one upon the other according to order to produce a compact and therefore readily storable package.

2. The sizing kit according to claim 1, wherein each of said ordered multiplicity of members is formed of plastic and is hollow.

3. The sizing kit according to claim 2, further comprising interconnecting means for interconnecting said ordered multiplicity of members when said members are stacked one upon the other to form said readily storable package.

4. The sizing kit according to claim 2, further comprising hanging means for hanging said readily storable package.

5. The sizing kit according to claim 4, wherein said hanging means comprises a tab formed on at least one of said multiplicity of members, said at least one tab being provided with a throughgoing hole.

6. The sizing kit according to claim 1, further comprising interconnecting means for interconnecting said ordered multiplicity of members when said members are stacked one upon the other to form said readily storable package.

7. The sizing kit according to claim 6, further comprising hanging means for hanging said readily storable package.

8. The sizing kit according to claim 7, wherein said hanging means comprises a tab formed on at least one of said multiplicity of members, said at least one tab being provided with a throughgoing hole.

9. The sizing kit according to claim 1, further comprising hanging means for hanging said readily storable package.

10. The sizing kit according to claim 9, wherein said hanging means comprises a tab formed on at least one of said multiplicity of members, said at least one tab being provided with a throughgoing hole.

11. A sizing kit for determining an appropriate size of orthopedic pillow for use by a patient, said sizing kit comprising:

an ordered multiplicity of members, each of said members having a substantially quadrilateral perimeter when viewed in plan, each of said substantially quadrilateral perimeters of said multiplicity of members having a substantially common first characterizing dimension and a second characterizing dimension, said second characterizing dimensions incresing from ordered member to ordered member such that the number of distinct second characterizing dimensions corresponds to the number of said multiplicity of members;

each of said members having an upper surface which comprises a substantially airfoil-shaped reverse curved surface when said members are viewed in elevation; and each of said ordered multiplicity of members, other than a first member of said ordered multiplicity, having a lower surface which substantially corresponds to said substantially airfoilshaped reverse curved upper surface of the preceding member in said ordered multiplicity;

whereby said ordered multiplicity of members are stackable one upon the other according to order to produce a compact and therefore readily storable package.

12. The sizing kit according to claim 11, wherein each of said ordered multiplicity of members is formed of plastic and is hollow.

13. The sizing kit according to claim 12, further comprising interconnecting means for interconnecting said ordered multiplicity of members when said members are stacked one upon the other to form said readily storable package.

14. The sizing kit according to claim 12, further comprising hanging means for hanging said readily storable package.

15. The sizing kit according to claim 11, further comprising interconnecting means for interconnecting said ordered multiplicity of members when said members are stacked one upon the other to form said readily storable package.

16. The sizing kit according to claim 15, further comprising hanging means for hanging said readily storable package.

17. The sizing kit according to claim 11, further comprising hanging means for hanging said readily storable package.

* * * * *